US007547196B2

(12) United States Patent
Boyer et al.

(10) Patent No.: US 7,547,196 B2
(45) Date of Patent: Jun. 16, 2009

(54) METHOD FOR MITIGATING ROD FLOAT IN ROD PUMPED WELLS

(75) Inventors: Lemoyne Boyer, Sugar Land, TX (US); Doneil M. Dorado, Missouri City, TX (US)

(73) Assignee: Lufkin Industries, Inc., Lufkin, TX (US)

( * ) Notice: Subject to any disclaimer, the term of this patent is extended or adjusted under 35 U.S.C. 154(b) by 598 days.

(21) Appl. No.: 11/228,109

(22) Filed: Sep. 16, 2005

(65) Prior Publication Data

US 2006/0067834 A1 Mar. 30, 2006

Related U.S. Application Data

(60) Provisional application No. 60/611,148, filed on Sep. 17, 2004.

(51) Int. Cl.
*F04B 49/00* (2006.01)

(52) U.S. Cl. ..... 417/22; 417/42; 417/53

(58) Field of Classification Search ..... 417/42, 417/22, 18, 328, 45, 53
See application file for complete search history.

(56) References Cited

U.S. PATENT DOCUMENTS 4,971,522 A * 11/1990 Butlin ..... 417/18
6,414,455 B1 * 7/2002 Watson ..... 318/432
6,506,030 B1 * 1/2003 Kottke ..... 417/328

* cited by examiner

*Primary Examiner*—Devon C Kramer
*Assistant Examiner*—Peter J Bertheaud
(74) *Attorney, Agent, or Firm*—Gary L. Bush; Brett T. Cooke; Andrew Kurth LLP

(57) ABSTRACT

Rod Float Mitigation (RFM) methods for rod-pumped oil wells having a variable frequency drive which controls the speed of the motor for the pump. Each method monitors rod loads or a similar condition and takes action only when rod load drops below a predefined minimum load. A first method reduces the speed of the motor to a preset level. A second method fixes the torque level on the pump downstroke by adjusting motor speed based on a calculated gearbox torque compared to a programmed fixed limit. Another method includes a program in the variable frequency drive which includes a preferred RFM Torque Curve for the pump to follow on its downstroke. When rod float occurs, the program monitors gearbox torque and adjusts the speed to follow the predetermined RFM Torque Curve thereby mitigating rod float with minimum decrease in production.

12 Claims, 6 Drawing Sheets

METHOD FOR MITIGATING ROD FLOAT IN ROD PUMPED WELLS

REFERENCE TO PREVIOUS APPLICATION

This Non-Provisional Application is based on Provisional Application 60/611,148 filed on Sep. 17, 2004 and claims the benefit of that filing date.

BACKGROUND OF INVENTION

1. Field of the Invention

This invention relates in general to control of rod pumped wells and in particular to control of rod pumping equipment for conditions where heavy crude oil production creates viscous and rod drag forces that cause the rod string to fall slower than the pumping unit motion on the downstroke.

2. Description of the Prior Art

When heavy crude oil production creates viscous and rod drag forces that cause the rod string to fall slower than the pumping unit downstroke motion, the pumping unit equipment can be damaged resulting in excessive maintenance costs and reduced production. A prior solution to that problem has been to install a variable frequency drive on the pumping unit and to manually slow the motor speed so that the pump speed is slowed to minimize rod float induced events. The problem with this prior approach is that well conditions change. For example, where heavy crude oil is being produced, cyclic steam injection, steam assisted gravity drainage (SAGD) and other secondary recovery operations require that steam be injected in the well for a time period, followed by pumping the well for a period of time to recover water and heavy crude oil. Well head temperatures change with time, and ambient temperature conditions affect flowline pressures which can adversely affect the rod-pump system with respect to rod float, rod loading and other operational conditions.

3. Identification of Objects of the Invention

A primary object of the invention is to provide Rod Float Mitigation (RFM) methods to detect rod float during rod pumping operations and to control the rod pumping apparatus to mitigate damage to the equipment while maximizing production.

SUMMARY OF THE INVENTION

The object identified above as well as other advantages and features of the invention are incorporated in a well pumping controller for a rod pumping system which includes a variable frequency drive (VFD). According to a first embodiment of the invention (called fixed speed option), a rod float condition is sensed by measuring rod load. A controller is provided to compare rod load with a programmed fixed value, and if the rod load falls below the programmed fixed value, then the speed of the VFD is reduced to a preset or fixed value.

According to a second embodiment (called fixed torque option) of the invention, a rod float condition is sensed as in the first embodiment, and when rod float is sensed by the controller, VFD speed is adjusted with a control signal such that the calculated net gear box torque does not exceed a programmed fixed torque limit.

According to a third embodiment of the invention (called variable torque curve option), a controller is activated only when the rod load falls beneath a predefined minimum load. When that condition is sensed, the controller commands the VFD to follow a RFM torque curve on the downstroke. The RFM torque curve is based on the pumping unit geometry and existing crank counterbalance of the pumping unit. This method of controlling the speed of the pumping unit minimizes the amount of speed droop needed to mitigate the rod float condition thereby optimizing production.

Detection of rod float can be obtained by means other than a direct rod load measurement. A proximity switch to detect separation of the carrier bar from the polished rod clamp may be used although such an arrangement may be less successful in practice due to the strict alignment required of a proximity switch. Another way to measure rod float is a direct position measurement of the polished rod and pumping unit carrier bar or related member. Such measurement may be accomplished by means of string position transducers, etched encoder position codes on the polished rod with corresponding sensor, etc.

DESCRIPTION OF PREFERRED EMBODIMENTS OF THE INVENTION

Figure 1:
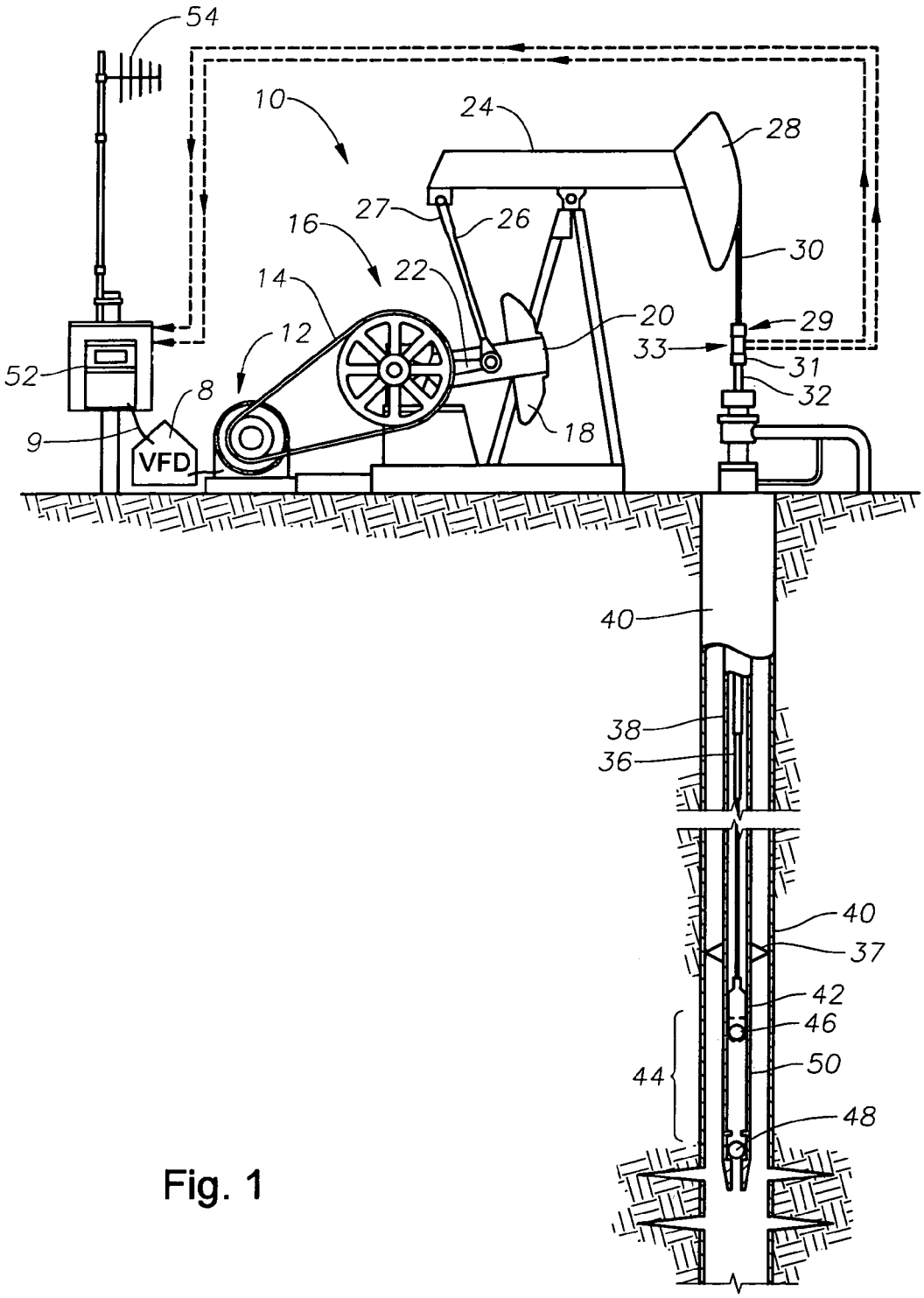
FIG. 1 shows an improved rod pumping unit equipped with a controller coupled to variable frequency drive (VFD) which varies the speed of a motor according to controller commands.

FIG. 1 shows an improved rod pumping system, generally indicated by reference number 10, including a prime mover 12, typically an electric motor. The system is equipped with a controller 52 coupled to variable frequency drive (VFD) 8 via a communication path 9. The controller 52 includes a microprocessor and controller software. The VFD 8 also includes a microprocessor and has its own VFD software. The VFD 8 controls the speed of the prime mover 12 as a function of control signals from controller 52. The rotational power output from the prime mover 12 is transmitted by a belt 14 to a gear box unit 16. The gear box unit 16 reduces the rotational speed generated by prime mover 12 and imparts rotary motion to a crank shaft end 22, a crank arm 20, and to a pumping unit counterbalance weight 18. The rotary motion of crank arm 20 is converted to reciprocating motion by means of a walking beam 24. Crank arm 20 is connected to walking beam 24 by means of a Pitman arm 26 and equalizer 27. A horsehead 28, wire rope bridle 30, and carrier bar 31 hang a polished rod 32 which extends through a stuffing box 34. A load cell 33 is mounted on the polished rod 32 such that it generates a signal representative of polished rod load between a polished rod clamp 29 and the carrier bar 31.

A rod string 36 of sucker rods hang from polished rod 32 within a tubing string 38 located in a casing 40. Tubing 38 can be held stationary to casing 40 by an anchor 37. The rod string 36 is connected to a plunger 42 of a subsurface pump 44.

Pump 44 includes a traveling valve 46, a standing valve 48, and a pump barrel 50. In a reciprocating cycle of the structure, including the walking beam 24, wire rope bridle 30, carrier bar 31, polished rod 32, rod string 36, and a pump plunger 42, fluids are lifted on the upstroke. When pump fillage occurs on the upstroke between the traveling valve 46 and the standing valve 48, the fluid is trapped above the standing valve 48. Most of this fluid is displaced above the traveling valve 46 when the traveling valve moves down. Then, this fluid is lifted toward the surface on the upstroke.

Rod float, also known as rod hang-up or carrier-bar separation, occurs when the polished rod 32 falls slower than the downward motion of the horsehead 28, wire rope bridle 30, and carrier bar 31. Rod float occurs largely due to excessive viscous and rod drag friction forces along the rod string 36 and in the pump 44. It is a result of pumping heavy crude at temperatures where the viscosity is high.

Since the bridle 30 is of the wire rope type, slack occurs usually resulting in separation between the carrier bar 31 and the clamp 29 at the top end of the polished rod 32. When slack exists in the bridle 30, the axial load in the polished rod 32 is zero.

The carrier bar 31 includes a clamping arrangement to retain the polished rod 32, but usually allows for relative linear movement. Thus the rod float event does not normally cause a catastrophic failure in the system, but significant mechanical stresses can occur when the polished rod 32 is once again picked up by the carrier bar 31, ending the rod float event. Likewise, the horsehead 28 generally includes a device to retain the bridle 30 to keep it on the face track of the horsehead 28 in the event slack occurs.

Figure 2:
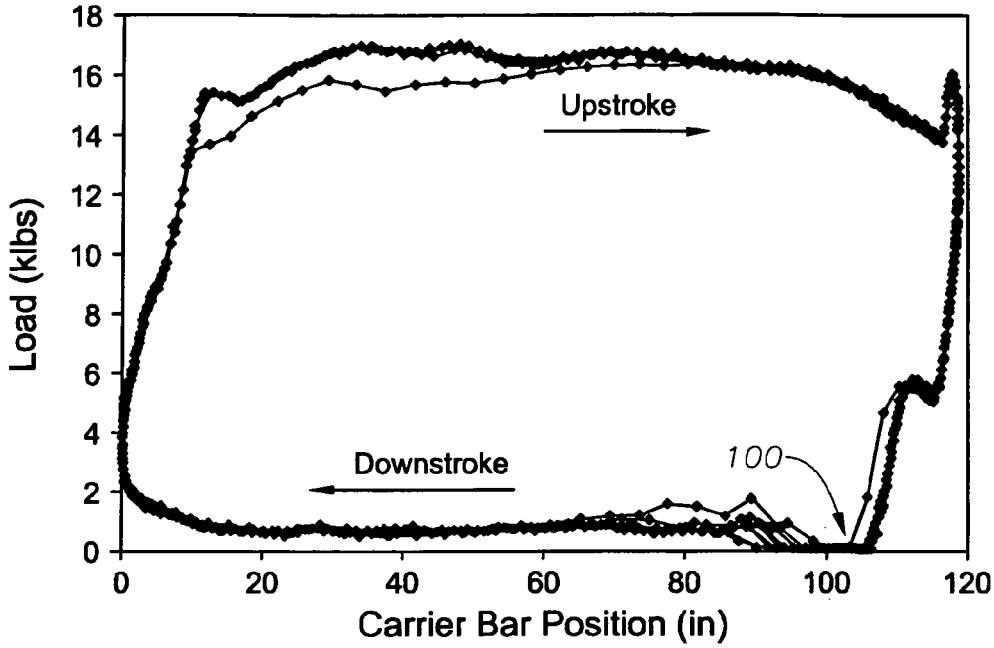
FIG. 2 shows a multiple trace surface dynamometer card showing minor rod float at the beginning of the rod downstroke.

FIG. 2 illustrates example surface dynamometer cards determined in controller 52 based on surface polished rod 32 load and carrier bar 31 position measurements. Polished rod load is preferably obtained from a load cell 33. Surface cards are produced by graphing load versus carrier bar position. Dashed lines of FIG. 1 between the load cell 33 and the carrier bar 31 illustrate rod load and position signals transmitted to controller 52. Such signals may also be transmitted to the VFD 8. Downhole pump cards can be determined by calculations which translate surface conditions of rod versus load to downhole pump conditions as first taught by Gibbs in U.S. Pat. No. 3,343,409. The surface cards of FIG. 2 illustrate rod float conditions 100 of the rod pump equipment 10, because the rod load drops to zero for a portion of each downstroke of rod reciprocation.

Figure 3:
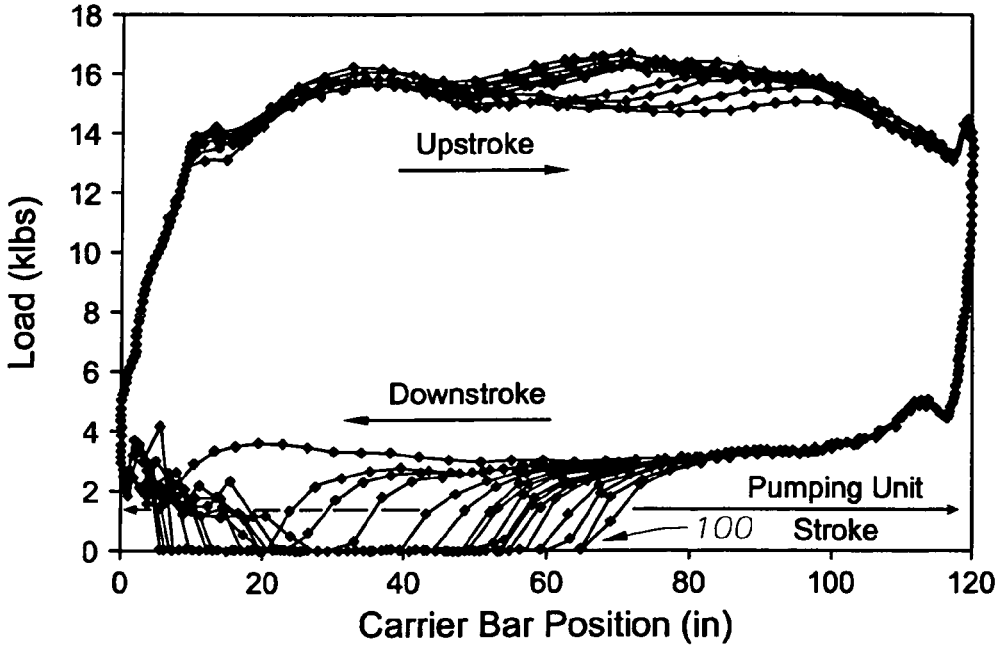
FIG. 3 shows a multiple trace surface card showing significant rod float during the rod downstroke, where rod float was exaggerated by increasing pumping unit speed.

FIG. 3 shows surface cards for the rod pump system 10 where rod float occurs for a greater portion of the downstroke than that of FIG. 2. The rod float condition of pump system 10 was exaggerated by increasing the pumping unit speed. Rod load drops to zero on every downward stroke (i.e., rod float conditions 100 are present), but at different polished rod positions on successive downstrokes. It should be observed that there is no loss in polished rod and pump stroke compared to the pumping unit stroke.

Figure 4:
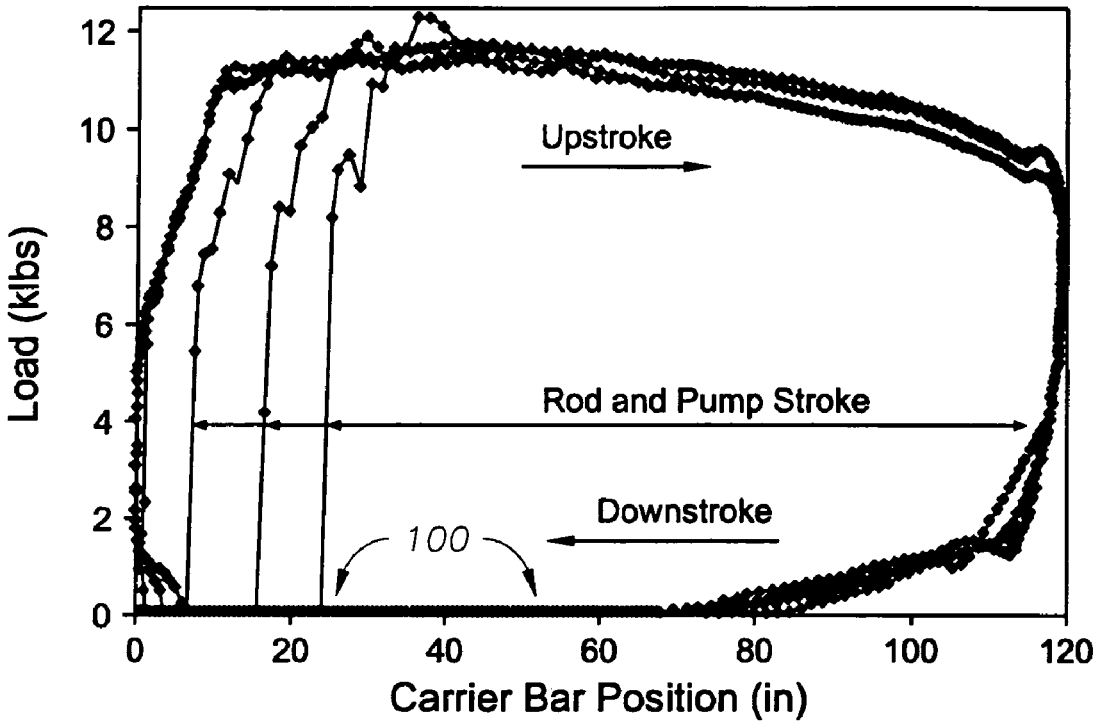
FIG. 4 shows a multiple trace surface card showing severe rod float sometimes ending on the upstroke.

FIG. 4 shows surface cards for a rod pump system 10 with severe rod float 100 (i.e., zero load condition for almost the entire downstroke). For several cycles, the rod position never extends to the bottom of the pumping unit stroke due to viscous fluid in the pump and tubing. For these cycles there is a loss of rod and pump stroke compared to the pumping unit stroke, resulting in a loss of production.

Figure 5A:
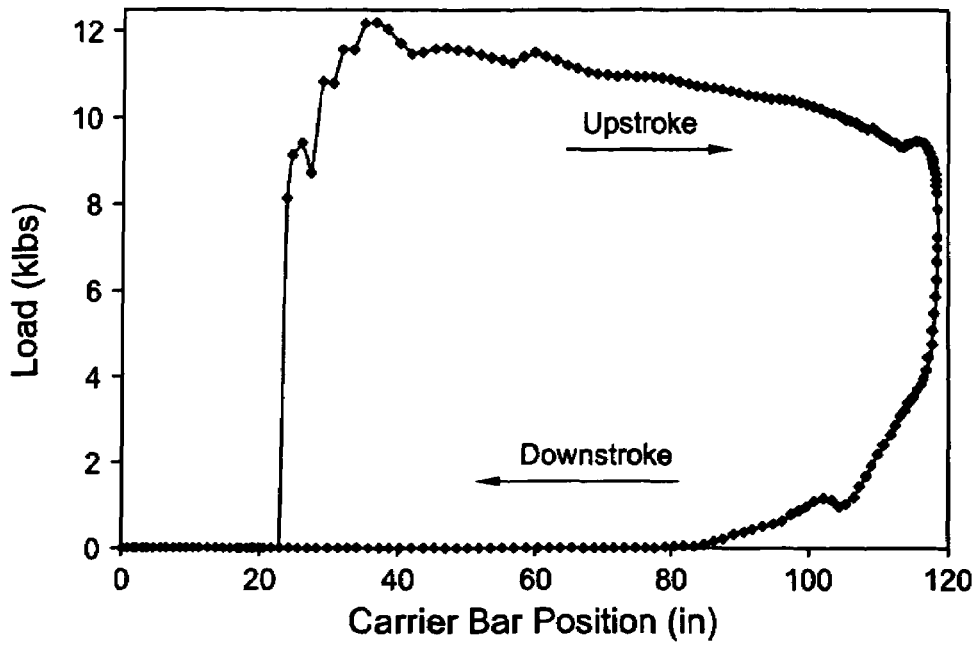
FIGS. 5*a* and 5*b* graphically illustrate how rod float affects gearbox torque and motor torque where rod float is on the pump downstroke and on part of the upstroke.

FIG. 5*a* shows a single surface card excerpted from FIG. 4 for a rod pump system 10 with severe rod float characterized by zero load for almost the entire downstroke and a portion of the upstroke.

Figure 5B:
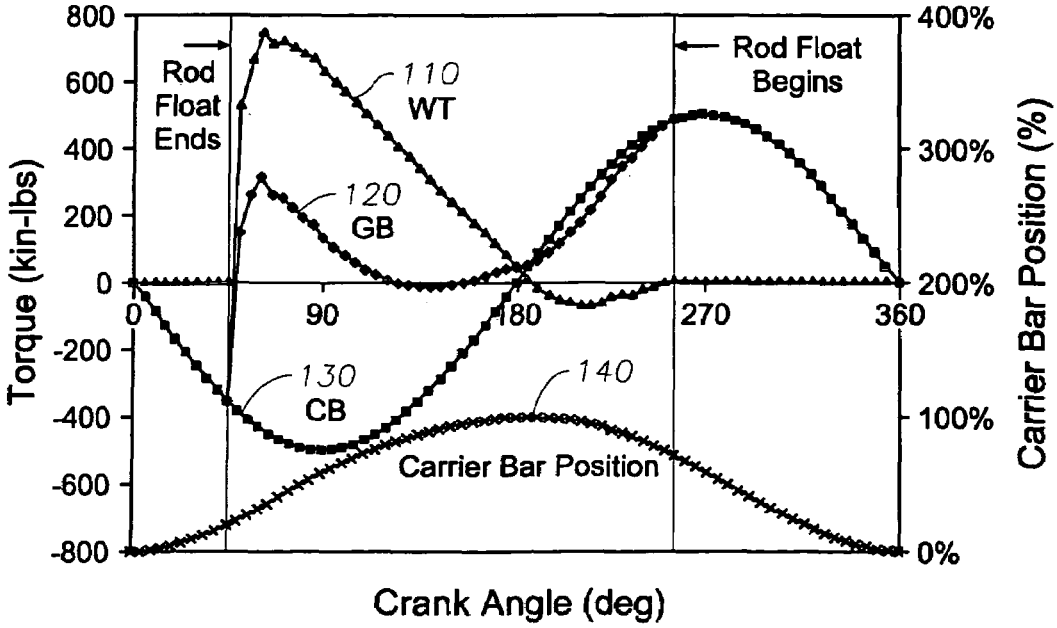

FIG. 5*b* illustrates a graph of well torque (WT) 110, net gear box (GB) torque 120, and counterbalance (CB) torque 130 versus crank angle that correspond to the surface card of FIG. 5*a*. Carrier bar position 140 versus crank angle is also shown for clarity. When the polished rod floats on the downstroke, the net gearbox torque 120 is approximately equal to the counterbalance torque 130 (neglecting inertia effects). The difference between net gear box torque 120 and counterbalance torque 130 is defined as well torque 110 and is the equivalent torque due to the well load. Rod float starts where well torque becomes zero as indicated.

Figure 6A:
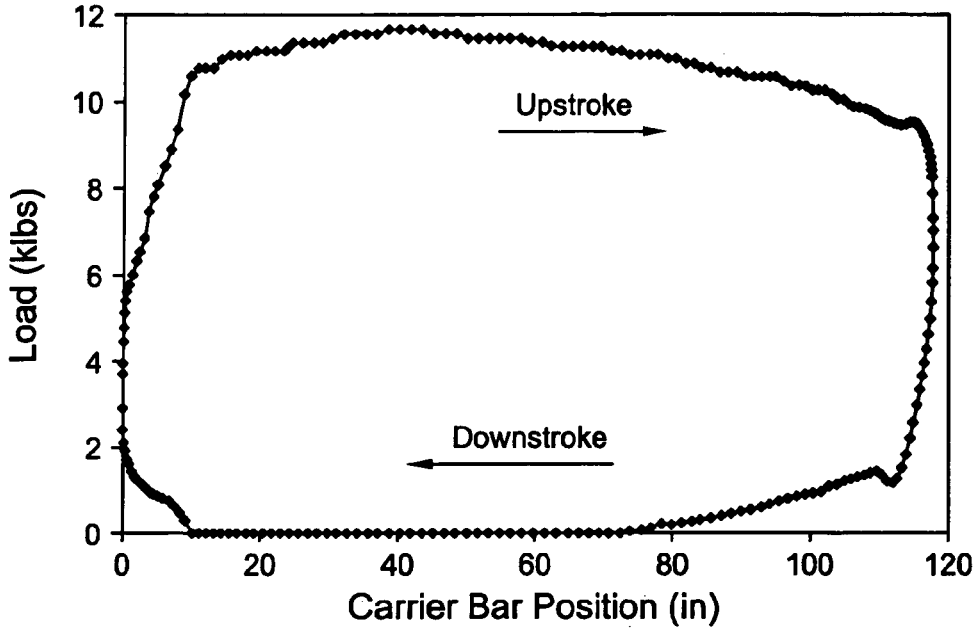
FIGS. 6*a* and 6*b* graphically illustrate how rod float affects gearbox torque and motor torque where rod float occurs only on the pump downstroke.
Figure 6B:
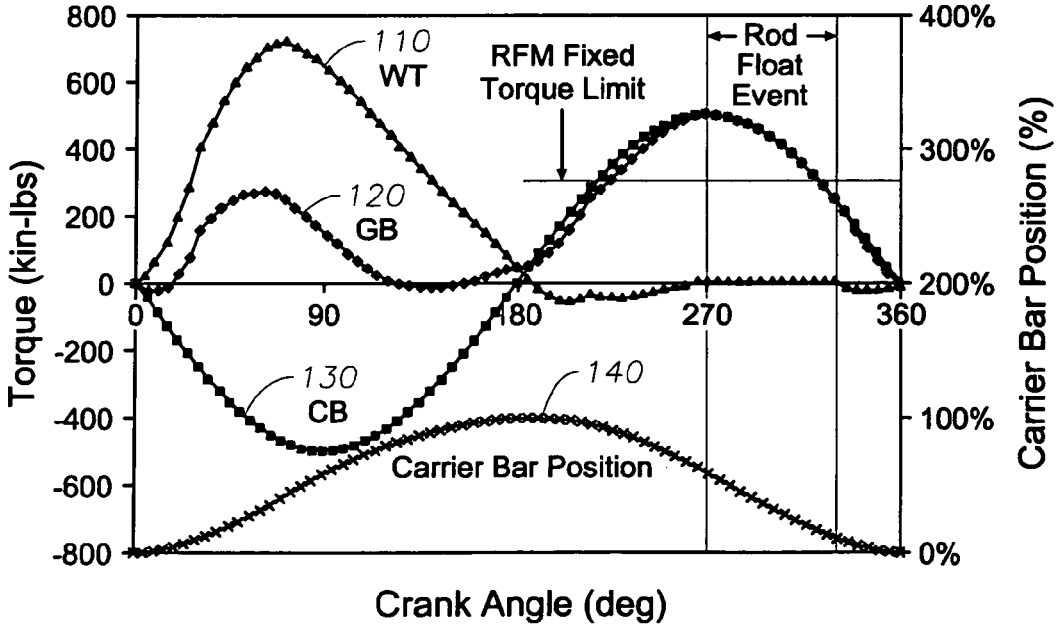

FIG. 6*a* shows a surface card where rod float affects only the downstroke. FIG. 6*b* illustrates determination of the initiation and end of rod float as a function of crank angle for the net gear box 16 torque 120, counterbalance 18 torque 130 and well torque 110.

Figure 7A:
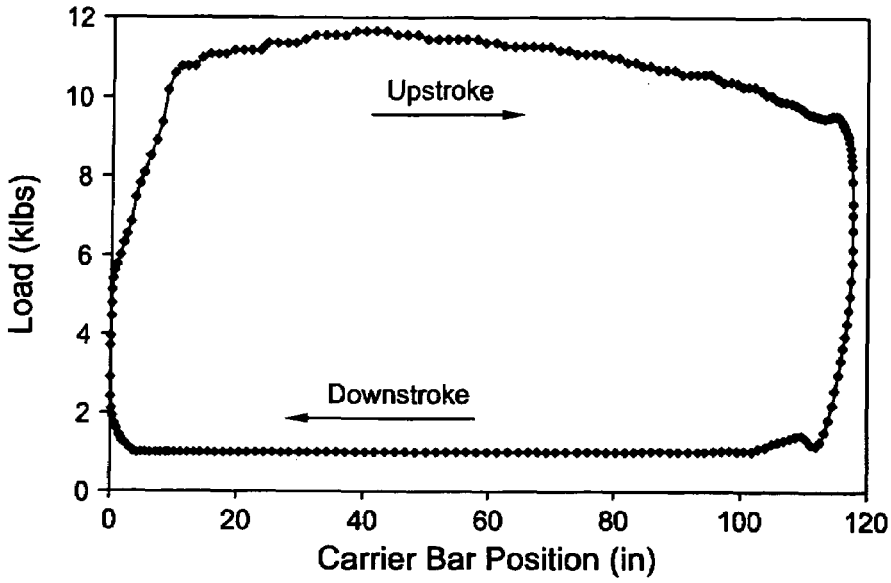
FIGS. 7*a* and 7*b* graphically illustrate a non-rod float condition and how the net gear box torque is normally less than the counterbalance torque on the pump downstroke.
Figure 7B:
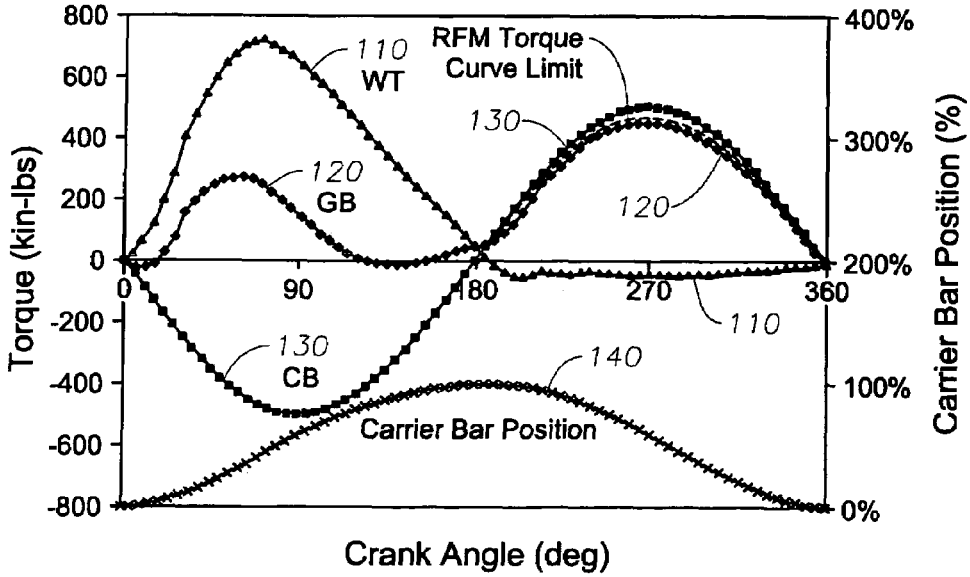

FIG. 7*a* illustrates a surface card in which rod float conditions are not present. FIG. 7*b* shows that the net gear box torque 120 is less than the counterbalance torque 130 on the downstroke from about 180 to 360 degrees. If there were an error in the calculated CB torque due to inaccuracies in calculation of crank angle, max counterbalance moment, $\Theta_{offset}$, $\tau$ or rotation key (RK) (as defined below), then there would be an inaccuracy in determining rod float from calculation of well torque 110 as the difference between net gear box torque 120 and counterbalance torque 130. A more direct approach to identifying a rod float event is to monitor when the polished rod load approaches within a threshold of zero.

A description of three methods for mitigating rod float for a rod pumping system follows.

First Embodiment

Fixed Speed Option

When software in the controller 52 (see FIG. 1) senses a low load signal from the surface card (e.g., loads below 200 lbs.), a digital output is sent via signal path 9 to the VFD 8, which may activate a rod float mitigation procedure according to a first embodiment. The VFD 8 controls the speed of prime mover 12 to a preset or fixed reduced value so long as the low load signal is present on signal path 9. Alternatively, the controller 52 detects the low load condition and changes the command speed being sent to the VFD 8 via signal path 9.

Second Embodiment

Fixed Torque Option

When software in the controller 52 senses a low load signal from the surface card (e.g., loads below 200 lbs.), a digital output is sent via signal path 9 to the VFD 8, which may activate a rod float mitigation procedure in software in the VFD 8 according to a second embodiment. Net gear box torque is a function of the motor speed and geometry of the mechanical linkage between motor 12 and the rod pump assembly, 32, 36, 42. VFD speed control to the motor is adjusted such that the calculated net gear box torque will not exceed a programmed fixed torque limit as is illustrated in FIG. 6*b*. In other words, the speed is slowed to a level such that the gear box curve 120 does not exceed the level labeled as RFM Fixed Torque Level. This method reduces any time lag between initiation of the low load signal and action on the part of the VFD 8 to match the pumping unit motion with the polished rod 32 fall.

Alternatively, software in the controller 52 can detect the low load condition and adjust the command speed being sent to the VFD 8 via lead 9 so that the torque limiting condition is maintained. This can be accomplished by calculating torque within the controller 52 since it has signals representative of the polished rod load (from load cell 33) and stored information about the geometry and counterbalance of the pumping unit. Alternatively, the controller 52 obtains the VFD 8 calculated torque as an analog output via signal path 9 and adjusts the speed being sent to the VFD so that the torque limit is maintained.

Third Embodiment

Variable Torque Curve Option

According to a third embodiment of the invention, a method is incorporated in software of the controller of FIG. 1 for controlling the variable frequency drive (VFD) 8 to mitigate rod float of the pumping unit 10. The definitions of parameters and measurements used in the method are as follows:

$$T_{counterbalance}=M*\sin(\Theta_{bottom\ of\ stroke}+RK*(\Theta_{offset}+\tau))$$

$$T_{net\ gb\ (at\ slow\ speed\ shaft)}=Tmotor*NREV_{ref}$$

- $T_{counterbalance}$ Torque applied at slow speed crank shaft 22 of gearbox 16 due to counterbalance weight 18 and crank weight 20 (in-lbs)
- $T_{net\ gb\ (at\ slow\ speed\ shaft)}$ Effective torque applied at slow speed crank shaft 22 due to motor 12 torque transmitted to gearbox 16 through drive train (in-lbs)
- M Maximum counterbalance moment, cranks at 90 degrees (in-lbs); provided by CONTROLLER 52
- RK rotation key ±1 depending on unit rotation (CW, CCW) and unit type; provided by CONTROLLER 52
- $\Theta_{offset}$ angle between 6 o'clock position (vertical) and crank angle at bottom of stroke, typically 6-15 degrees; provided by CONTROLLER 52
- $\tau$ angle between counterbalance and crank angle, typically 0 for conventional units, 20+degrees for Mark II units; provided by CONTROLLER 52
- $NREV_{ref}$ overall speed ratio, also number of motor revolutions per crank cycle, parameter provided by CONTROLLER 52
- $\Theta_{bottom\ of\ stroke}$ Crank angle relative to bottom of stroke (deg); at each motor revolution i, the angle can be calculated as $i*360/NREV_{ref}$ with a bottom of stroke digital input to CONTROLLER 52
- Tmotor motor torque (in-lbs) calculated by VFD 8 or CONTROLLER 52

Torque curve rod float control is accomplished by the controller 52 sending a digital output pulse via signal path 9 at the bottom of stroke (and optionally a second digital pulse is sent also at the top of stroke, for improved position detection) which the VFD 8 monitors. The VFD 8 uses its internal motor model to estimate motor 12 rpm and subsequently pumping unit angle (position). The VFD 8 alternatively utilizes its own rpm input to directly measure pumping unit angle.

When the controller 52 senses a low load input (e.g., loads below 200 lbs.) from the surface card (See FIGS. 2, 3, 4), a digital output is sent via lead 9 to the VFD 8, which activates the rod float mitigation procedure according to the invention.

If $T_{net\ gb(at\ slow\ speed\ shaft)}$ on the downstroke approaches within a threshold amount of the $T_{counterbalance}$ (this could be a percentage or actual value, e.g. if $T_{net\ gb}>=95\%*T_{counterbalance}$ or if $((T_{counterbalance}-T_{net\ gb})<=20{,}000$ in-lbs), then the drive 8 is programmed to control the speed of motor 12 to try to maintain the net gearbox torque at the threshold value, while the low load signal digital output is active. The Rod Float Mitigation (RFM) algorithm is only active when the pumping unit is on the downstroke and the rod load is below the programmed load threshold. This calculated torque curve limit is illustrated in FIG. 7*b* where a threshold percent is set at about 95%. This method is most effective at optimizing production, because the unit is not slowed any more than necessary to mitigate the floating condition.

As in the second embodiment, an alternative approach is to have the controller 52 detect the low load condition and adjust the command speed being sent to the VFD 8 via signal path 9 so that the torque limiting condition is maintained. This is accomplished by calculation of torque within the controller 52, because it has stored information regarding the polished rod load, geometry and counterbalance of the pumping unit.

Another alternative means of control for the controller 52 provides that it obtains the VFD 8 calculated torque as an analog output via signal path 9 and adjusts the speed being sent to the VFD 8 so that the torque limit is maintained.

Effects of system inertia have been neglected in the embodiments described above. Indeed during normal operation, the pumping unit speed is relatively constant and inertia effects are minimal. However, during the transient speed changes prescribed in the above embodiments inertia effects should be taken into account in the embodiments described above. Because system inertia influences dynamic torques when the unit is decelerating or accelerating, it may be necessary to further reduce the torque limit while the pumping unit is being decelerated. Likewise it may be necessary to increase the torque limit upon acceleration. The rotary inertia torque is added/ subtracted to the programmed fixed torque limit in the second embodiment, or to the programmed threshold limit as described in the third embodiment. The value of this rotary inertia torque is equal to the product of the system inertia (usually referred to the slow speed gear box shaft) and the angular acceleration. A similar procedure can be followed if it is desired to account for the articulating inertia effect. However it is usually much smaller than the rotary effect.

What is claimed is:

1. In a rod pumping arrangement including a motor (12) coupled by a mechanical linkage to a polished rod (32), rod string (36), subsurface pump (44) assembly, wherein said motor and mechanical linkage cause said assembly to reciprocate in a borehole, and a variable frequency drive (8) coupled to said motor (12) for controlling speed of rotation of said motor, a method for mitigating rod float comprising the steps of, providing a controller (52) with software and data memory and with a signal path (9) provided between the controller (52) and said variable frequency drive (8), producing an operating load level representative of polished rod (32) load during assembly downstroke while said assembly is reciprocating in said borehole, operating said software in said controller to compare said operating load level with a predetermined load limit indicative of a rod float condition stored in said data memory and generating a low load signal only while said operating load level is below said predetermined load limit, applying said low load signal via a signal path (9) to said variable frequency drive (8), and controlling the speed of said motor (12) with said variable speed drive as long as said low load signal is applied.

2. The method of claim 1 wherein said variable speed drive controls the speed of said motor to a fixed lower speed as long as said low load signal is applied.

3. The method of claim 1 wherein said low load signal includes a level representative of the difference between said operating load level and said predetermined load limit, and said variable speed drive controls the lowering of the level of speed of said motor as a function of said level of said low load signal as long as said low load signal is applied.

4. In a rod pumping arrangement including a motor (12) connected to a gearbox (16) coupled by a mechanical linkage to a polished rod (32), rod string (36), subsurface pump (44) assembly, wherein said motor, gearbox and mechanical linkage cause said assembly to reciprocate in a borehole and a variable frequency drive (8) is coupled to said motor for controlling motor speed, a method for mitigating rod float comprising the steps of providing a controller (52) with software and data memory and with a signal path (9) provided between the controller (52) and said variable frequency drive, producing an operating load level representative of polished rod (32) load during assembly downstroke while said assembly is reciprocating in said borehole, operating a first software program in said controller to compare said operating load level with a predetermined load limit indicative of a rod float condition stored in said data memory and generating a low load signal while said operating load level is below said predetermined load limit, applying said low load signal via a signal path (9) to said variable frequency drive (8), providing a second software program to generate a calculated net gear box torque and a corresponding motor speed signal such that calculated net gear box torque does not exceed a predetermined variable torque limit as long as said low load signal is applied.

5. The method of claim 4 wherein, said second software program is within a processor of said variable frequency drive (8).

6. The method of claim 4 wherein, said second software program is within said controller (52) and said motor speed signal is applied to said variable speed drive (8) via said signal path (9).

7. The method of claim 6 further comprising the steps of storing data representative of geometry and counterbalance of said mechanical linkage in said data memory of said controller, providing a load cell (33) on said polished rod (32) to generate load signals on said polished rod, and computing said calculated net gear box torque as a function of said polished rod load signals and said geometry and counterbalance data.

8. The method of claim 4 wherein, said calculated net gear box torque is computed in software of said variable frequency drive and is applied to said controller 52, and said software of said controller 52 generates a corresponding motor speed such that calculated net gear box torque does not exceed said predetermined fixed torque limit as long as said low load signal is applied.

9. In a rod pumping arrangement including a motor (12) connected to a gearbox (16) coupled by a mechanical linkage to a polished rod (32), rod string (36), subsurface pump (44) assembly wherein said motor, gearbox and mechanical linkage cause said assembly to reciprocate in a borehole, and a variable frequency drive (8) is coupled to said motor (12) for controlling motor speed, a method for controlling motor speed comprising the steps of, providing a controller (52) with first software and data memory and with a signal path (9) provided between the controller (52) and said variable frequency drive, producing an operating load level representative of polished rod (32) load during assembly downstroke while said assembly is reciprocating in said borehole, operating said first software in said controller to compare said operating load level with a predetermined load limit indicative of a rod float condition stored in said data memory and generating a low load signal while said operating load level is below said predetermined load limit, applying said low load signal via a signal path (9) to said variable frequency drive (8), activating rod float mitigation software when said low load signal is applied by determining in software an estimate of motor (12) speed and pumping unit angle position using stored parameters of M, RK, $\Theta_{offset}$, $\tau$, $NREV_{ref}$, $\Theta_{bottom\ of\ stroke}$, to determine Tmotor, determining if $T_{net\ gb\ (at\ slow\ speed\ shaft)}$ on the downstroke of said assembly exceeds a threshold value of $T_{counter\text{-}balance}$, and if so controlling the speed of the motor (12) by control from said variable frequency drive (8) to maintain $T_{net\ gb}$ at said threshold value, so long as said low load signal is applied, where $$T_{counterbalance}=M^{*}\mathrm{Sin}(\Theta_{bottom\ of\ stroke}+RK^{*}(\Theta_{offset}+\tau))$$

Torque applied at slow speed crank shaft 22 of gearbox 16 due to counterbalance weight 18 and crank weight 20 (in-lbs)

$$T_{net\ gb\ (at\ slow\ speed\ shaft)}=\mathrm{Tmotor}^{*}NREV_{ref}$$

Effective torque applied at slow speed crank shaft 22 due to motor 12 torque transmitted to gearbox 16 through drive train (in-lbs)

M Maximum counterbalance moment, cranks at 90 degrees (in-lbs); provided by controller 52

RK rotation key±1 depending on unit rotation (CW, CCW) and unit type; provided by controller 52

$\Theta_{offset}$ angle between 6 o'clock position (vertical) and crank angle at bottom of stroke, typically 6-15 degrees; provided by controller 52

$\tau$ angle between counterbalance and crank angle, typically 0 for conventional units, 20+ degrees for Mark II units; provided by controller 52

$NREV_{ref}$ overall speed ratio, also number of motor revolutions per crank cycle, parameter provided by controller 52

$\Theta_{bottom\ of\ stroke}$ Crank angle relative to bottom of stroke (deg); at each motor revolution i, the angle can be calculated as $i^{*}360/NREV_{ref}$ with a bottom of stroke digital input to controller 52

Tmotor motor torque (in-lbs).

10. The method of claim 9 wherein

Tmotor is determined in software of said variable frequency drive (8).

11. The method of claim 9 wherein

Tmotor is determined in software in controller (52).

12. The method of claim 10 wherein

Tmotor from said variable frequency drive (8) is applied to said controller (52) for generation of an adjusted speed signal to said variable frequency drive so that said torque of said motor is maintained at said threshold limit.

* * * * *